United States Patent [19]

Bonilla et al.

[11] Patent Number: 4,686,027

[45] Date of Patent: Aug. 11, 1987

[54] ASPHALT COKING METHOD

[75] Inventors: Jorge A. Bonilla, S.W. Calgary, Canada; John D. Elliott, Randolph, N.J.

[73] Assignee: Foster Wheeler USA Corporation, Livingston, N.J.

[21] Appl. No.: 751,048

[22] Filed: Jul. 2, 1985

[51] Int. Cl.[4] ..... C10G 9/14; C10C 3/00; C10C 3/08

[52] U.S. Cl. ..... 208/39; 208/45; 208/87; 208/131; 208/309

[58] Field of Search ..... 208/309, 131, 87, 45

[56] References Cited

U.S. PATENT DOCUMENTS

| | | | |
|---|---|---|---|
| 2,222,060 | 11/1940 | Arveson | 196/50 |
| 2,337,448 | 12/1943 | Carr | 196/13 |
| 2,727,853 | 12/1955 | Hennig | 196/49 |
| 3,281,350 | 10/1966 | Codet et al. | 208/62 |
| 3,617,481 | 11/1971 | Voorhies, Jr. | 208/50 |
| 4,066,532 | 1/1978 | Garcia | 208/131 |
| 4,235,700 | 11/1980 | Melrailer | 208/131 |
| 4,292,170 | 9/1981 | Simone | 208/87 |
| 4,324,651 | 4/1982 | Rollmann et al. | 208/309 |
| 4,394,250 | 7/1983 | Grossberg | 208/131 |
| 4,448,672 | 5/1984 | Angerine et al. | 208/309 |
| 4,497,705 | 2/1985 | Weinberg et al. | 208/309 |
| 4,528,088 | 7/1985 | Chang et al. | 208/131 |
| 4,534,854 | 8/1985 | Weinberg et al. | 208/131 |

FOREIGN PATENT DOCUMENTS

| | | | |
|---|---|---|---|
| 1162981 | 1/1953 | Australia | 208/309 |
| 2834475 | 3/1979 | Fed. Rep. of Germany | 208/309 |
| 1075704 | 6/1976 | Japan | 208/39 |

*Primary Examiner*—John Doll
*Assistant Examiner*—Helane Myers
*Attorney, Agent, or Firm*—Marvin A. Naigur; John P. Shannon

[57] ABSTRACT

A delayed coking process and a solvent deasphalting process are combined so that an asphalt mix of asphalt and solvent from the solvent deasphalting process is sent as feedstock to the delayed coking process to form coke and intermediate hydrocarbon vapor and liquid products. The vaporization of the solvent in a delayed coker heater assists the flow of the asphalt mix through the heater, and a portion of the asphalt mix is directed to a delayed coking fractionator so that the flow of solvent through the delayed coking heater can be adjusted by varying the relative amounts of asphalt mix sent to the delayed coker heater and to the fractionator. A deasphalted oil mix of deasphalted oil and solvent from the solvent deasphalting process is heated by hotter fluid products from a fractionator in the delayed coking process, and makeup solvent to a solvent deasphalting section is heated by vapors in the fractionator overhead. The solvent is recovered from the deasphalted oil mix to yield deasphalted oil, which is stripped in the same vessel as products from the fractionator of the delayed coking process. Condensation of the vapors from the fractionator overhead produces sufficient lean oil that a separate lean oil still may not be required for the economic recovery of coker liquefied petroleum gases. Solvent may be recoverd from the lean oil and naphtha products to supplement the makeup solvent.

12 Claims, 1 Drawing Figure

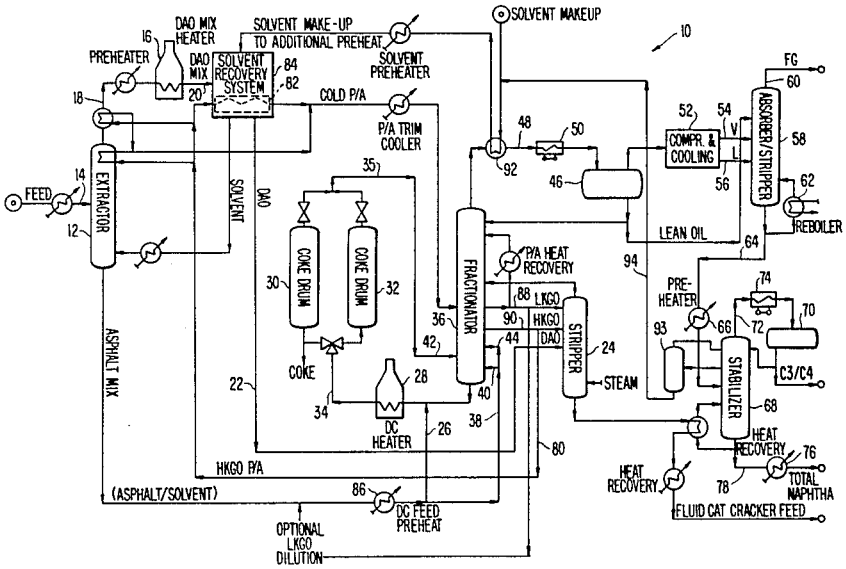

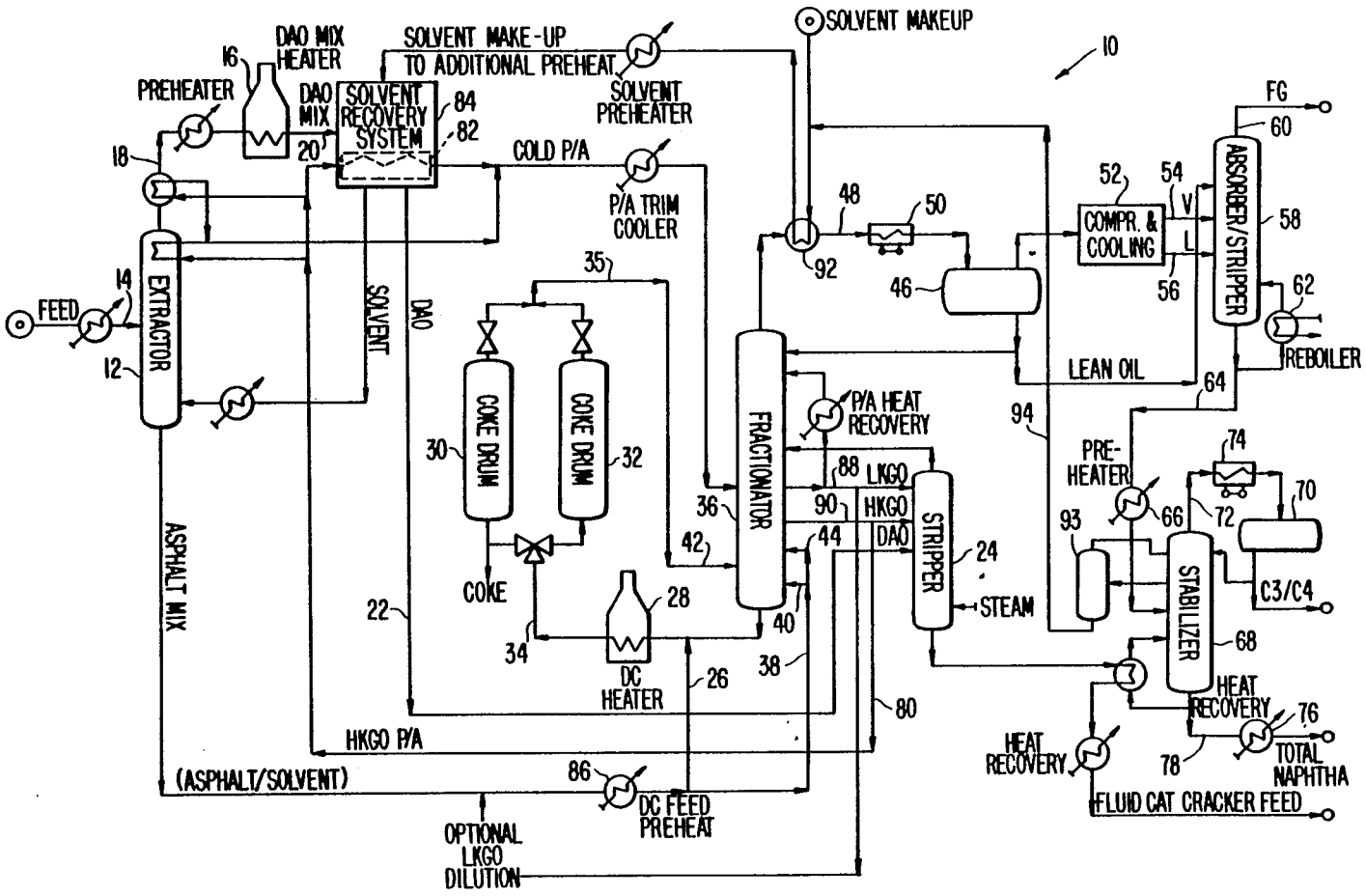
ABSORBER/STRIPPER
REBOILER
FG
COMPR. & COOLING
LEAN OIL
STABILIZER
C3/C4
HEAT RECOVERY
TOTAL NAPHTHA
FLUID CAT CRACKER FEED
PRE-HEATER
STEAM
STRIPPER
SOLVENT MAKEUP
P/A HEAT RECOVERY
LKGO
HKGO
DAO
FRACTIONATOR
SOLVENT PREHEATER
P/A TRIM COOLER
DC HEATER
DC FEED PREHEAT
COKE DRUM
COKE DRUM
COKE
SOLVENT MAKE-UP TO ADDITIONAL PREHEAT
COLD P/A
SOLVENT RECOVERY SYSTEM
DAO
SOLVENT
HKGO P/A
OPTIONAL LKGO DILUTION
DAO MIX HEATER
DAO MIX
PREHEATER
EXTRACTOR
ASPHALT MIX
(ASPHALT/SOLVENT)
FEED

ASPHALT COKING METHOD

BACKGROUND OF THE INVENTION

The present invention relates to the treatment of heavy hydrocarbons, and more particularly to the refining of the heavy bottoms of petroleum.

Coking is a process in which the heavy residual bottoms of crude oil are thermally converted to lower-boiling petroleum products and by-product petroleum coke, and delayed coking involves the rapid heating of reduced crude in a furnace and then confinement in a coke drum under proper conditions of temperature and pressure until the unvaporized portion of the furnace effluent is converted to vapor and coke. Coke obtained by delayed coking from conventional residue feeds is almost pure carbon, called sponge coke, which is often employed in the production of electrodes for the aluminum industry, and special feeds produce premium coke, called needle coke, which is used in the manufacture of high quality graphitic electrodes important to the steel industry. A solvent deasphalting process is another of such heavy bottoms treatment processes, in which asphalt is removed from a feedstock, such as whole crude, atmospheric or vacuum residues, or any other heavy oil stream rich in asphaltenes, by the use of a solvent, such as propane, butane or other light hydrocarbons. In such a process, the feedstock is contacted with the solvent in an extractor, from which an asphalt mix containing asphalt and solvent are removed, and the asphalt is separated from the solvent in an asphalt recovery system. The extractor also produces a deasphalted oil mix of deasphalted oil and solvent, which is sent through a solvent recovery system including a deasphalted oil stripper before the deasphalted oil is sent on to refining as cracker feedstock (fluid catalytic cracker or hydrocracker).

Such processes yield by-products (coke or asphalt) from the heavy oil and valuable intermediate products for further refining in which primary products such as gasoline and gas oil are produced. With each process there are limits to the portion of the heavy bottoms which can be converted into the more valuable intermediate products, and so the remainder is converted to by-products. The processes require substantial amounts of energy to provide necessary heat, some of which is later lost, and they involve significant costs in equipment and piping. For example, the solvent deasphalting process involves the heating of the deasphalted oil mix, and requires the use of energy external to the process in order to supply the heat. In addition, the deasphalted oil taken from the solvent recovery system needs stripping before further use can be made of it, thus requiring equipment to perform the needed functions. In addition, some such processes produce waste material, which presents a pollution problem, since the waste material requires treatment and disposal. In the delayed coking process, the residence time in the delayed coker heater of the feed must be controlled to insure adequate heating of the feedstock while preventing the quick formation of coke deposits in the heater, since such deposits necessitate the shut down of the delayed coking apparatus while the heater is cleaned. Ordinarily such control of residence time requires the injection into the feed of a fluid such as steam or condensate to provide adequate flow velocities of the feedstock through the delayed coker heater. Such injection produces sour water and adds to waste treatment and disposal load associated with refining.

SUMMARY OF THE INVENTION

In order to increase the liquid yield from the heavy bottoms of petroleum, to obtain the benefits of delayed coking and deasphalting, and to reduce energy consumption, equipment requirements and waste production, it is an object of the present invention to combine and interconnect a delayed coking process and a solvent deasphalting process. More specifically, the method according to the present invention increases the liquid yield for an integrated bottom-of-the-barrel refinery conversion system by reducing the coke yield per barrel of crude to the refinery. It also utilizes heat which would ordinarily be wasted, if the processes were separate, to supply needed heat at certain required points in the combined process, thereby eliminating the need for additional energy to produce the needed heat. The combination of the processes decreases the need for external fluids, such as steam, thereby reducing the waste and pollution problems that arise as a result of the contamination of such external fluids by the fluids being processed. Furthermore, equipment which ordinarily would be required in the individual processes is eliminated as a result of their combination.

In the present invention, the feed is contacted by a solvent, such as light naphtha, in a solvent deasphalting section of the process in an extractor from which a portion of the feed is taken off as a deasphalted oil mix which is sent through a solvent recovery system to a catalytic cracker or hydrocracker where it yields primary products. In a conventional delayed coker, this portion of the feed would be sent with the rest of the feed to a delayed coker, where some of the portion would form coke, thereby reducing the amount available to form primary products. Intermediate products are obtained from asphalt mix, a mixture of asphalt and solvent leaving the bottom of the extractor, which is sent directly to a delayed coker heater in the delayed coker section, thereby providing the feedstock from which the coke is formed. The asphalt, which is separated from the asphalt mix in conventional solvent deasphalting processes, includes a portion which adds to the coke production in the delayed coker section and a portion which yields intermediate products. The feeding of the asphalt mix to the delayed coking section also eliminates the need for an asphalt solvent recovery section, which typically includes equipment such as heat exchangers, vessels and a furnace.

The presence of the solvent in the asphalt mix, through its vaporization in the delayed coker heater, provides adequate fluid velocities of the asphalt mix through the heater conduits to provide proper residence time of the asphalt mix in the heater, thereby reducing or totally eliminating the need for steam or condensate injection into the asphalt mix. In contrast, the steam or condensate, which otherwise are solely relied on to provide necessary fluid velocities in the heater tubes, produce sour water which must be treated. Since by the combined process according to the present invention little or no water is injected into the heater, the amount of sour water condensed in the fractionator overhead is reduced.

The solvent condenses in overhead condensers connected to a fractionator associated with the delayed coking section, from which the solvent can be used as lean oil for high recovery of $C_3/C_4$ hydrocarbons in an absorber/ stripper. The solvent recovered from the fractionator overhead eliminates the need for lean oil recirculation to the absorber/stripper and reboiling of the lean oil, as well as the requisite equipment to provide such recirculation and reboiling. The heat of the products from the coker fractionator is used in other portions of the combined system and apparatus. For example, heavy coker gas oil pump around generated in the coker fractionator is used to provide most of the heat needed to heat the deasphalted oil mix in association with a solvent recovery system in the solvent deasphalting section, thereby minimizing the amount of external energy which must be added to the combined process to heat the deasphalted oil mix in a deasphalted oil mix heater, and heat recovery from light coker gas oil pump-around can also be applied in other areas. A deasphalted oil stripper and its condenser, which are required in the deasphalting process by itself, are normally eliminated from the solvent recovery section in the combined process, and the stripping of the deasphalted oil is accomplished together with the stripping of the heavy coker gas oil and light coker gas oil in a stripper in the delayed coker section. A mixture of deasphalted oil, heavy coker gas oil and light coker gas oil is obtained from the coker stripper at a relatively high temperature and at a reasonably constant flow, thereby being capable of providing heat for other portions of the apparatus, such as in the delayed coker vapor recovery section. Where light naphtha is used as the solvent, the deasphalting solvent introduced into the delayed coker section as a part of the asphalt mix is recovered as a part of the total naphtha in the delayed coker vapor recovery unit. Makeup solvent to the combined process is preheated using heat from the delayed coker fractionator overhead and other hot streams in the delayed coker and solvent deasphalting sections.

BRIEF DESCRIPTION OF THE DRAWING

The FIGURE is a schematic illustration of the combined solvent deasphalting and delayed coking apparatus according to the present invention.

DETAILED DESCRIPTION OF THE PREFERRED EMBODIMENT

In the FIGURE, the apparatus for the process according to the present invention is designated generally by the reference numeral 10. The apparatus includes a solvent deasphalting section, in which a heavy hydrocarbon feed, such is whole crude, atmospheric or vacuum residues or any other heavy oil stream rich in asphaltenes, is contacted with a solvent to produce an asphalt mix, which is a mixture of asphalt and the solvent, and a deasphalted oil mix, which is a mixture of deasphalted oil and the solvent. The apparatus also includes a delayed coking section, integrated with the solvent deasphalting section, which forms coke from a feed of the asphalt mix from the solvent deasphalting section of the apparatus.

The solvent deasphalting section includes an extractor 12, which can be of conventional construction such as a mixer-settler, a slat tower or a rotating disc contactor, in which the heavy hydrocarbon feed received through a line 14 is contacted with a solvent, such as light naphtha, $C_4$, $C_5$, or $C_6$ hydrocarbons, or a mixture thereof. The light naphtha, for example, can be cut at a point such that it has a final boiling point of about 180° F. A deasphalted oil mix heater 16 receives the deasphalted oil mix from the extractor through a line 18 to supply any heat necessary to supplement heat supplied by heavy coker gas oil pumparound from the delayed coking section, as will be described in greater detail hereinafter. The heated deasphalted oil mix is fed through a line 20 to a solvent recovery system in which the solvent is separated from the mix, leaving deasphalted oil, which is fed through a line 22 to a stripper 24 in the delayed coking section.

In the delayed coking section, the asphalt mix is received through lines 25 and 26 to a delayed coker heater 28 which raises the asphalt mix to a temperature sufficient to permit coke to form in coke drums 30 and 32 to which the asphalt is fed through a line 34 and in which the mix is maintained under the proper conditions of temperature and pressure until the unvaporized portion of the mix is converted to coke and hydrocarbon vapors. The heated asphalt mix is ordinarily fed to the coke drums 30 and 32 alternately and discharged alternately, as is conventional in delayed coking processes. The vaporized portion of the asphalt mix passes from the coke drums 30 and 32 through a line 35 to a fractionator 36 from which liquid petroleum products, such as light coker gas oil and heavy coker gas oil are taken off. In addition to being fed to the delayed coker heater 28, part of the asphalt mix can also be directed to the fractionator 36 through lines 25 and 38, into the fractionator bottoms through an inlet line 40, or above a coke drum vapor inlet 42 through an inlet line 44, or both. The asphalt mix fed to the fractionator 36 then is directed to the coker heater 28 through an outlet at the bottom of the fractionator.

Associated with the fractionator overhead is a fractionator overhead drum 46 which receives vapor and liquid from the fractionator through a line 48 containing a cooler 50 such as a fan cooler and in which the solvent and other hydrocarbons in the fractionator vapor condense to yield lean oil, fractionator reflux and net product naphtha. The fractionator gas remaining after condensation is compressed and cooled in a compression and cooling system 52 and sent in vapor and liquid portions through lines 54 and 56, respectively, to an absorber/stripper 58. The absorber/stripper 58 includes an absorber section in its upper portion in which the lean oil flows down to scrub heavier material, such as liquefied petroleum gases and $C_3$'s and $C_4$'s out of the rising vapors from the compression and cooling system 52, so that fuel gas, having such constituents as methane, hydrogen, ethane, ethylene and other light hydrocarbonaceous vapors, is taken off in the absorber/stripper overhead in a line 60. A reboiler 62 is employed in connection with a stripper section of the absorber/stripper 58, and the heavier material, which includes propane and heavier constituents, is fed through a line 64 having a preheater 66 to a stabilizer 68 in which the $C_3$'s and $C_4$'s are separated and recovered in stabilizer overhead drum 70, fed by line 72 having a cooler 74 while the remainder yields total naphtha from which heat can be recovered by a heat exchanger 76 in a line 78 and applied to other portions of the process.

In the process according to the present invention, the heavy coker gas oil pumparound from the delayed coker fractionator 36 is pumped through a line 80 to add heat by means of one or more heat exchangers 82 to the deasphalted oil mix within a solvent recovery system 84. The heat from the heavy coker gas oil pumparound is often sufficient by itself to supply the heat necessary for the recovery of the solvent from the deasphalted oil mix. However, the deasphalted oil mix heater 16, using separate energy, such as natural gas or fuel oil, as is used in the solvent deasphalting process ordinarily with heavy solvents, is provided to supplement the heat supplied by the heavy coker gas oil pumparound. The remaining heat from the heavy coker gas oil pumparound after exchange in the heat exchangers 82 can be applied to other portions of the combined solvent deasphalting and delayed coking apparatus. The solvent recovery system 84 can comprise a multistage vaporization system or a supercritical solvent recovery system, as used in the solvent deasphalting process ordi- narily.

The flow of the solvent to the delayed coker heater 28 is controlled by varying the relative amounts of the asphalt mix fed directly to the delayed coker heater 28 with respect to the amounts fed to the fractionator 36, either into the fractionator bottoms or above the coke drum vapor inlet 42. This is due to the stripping of the solvent from the asphalt mix injected through the inlet line 44 by the coke drum vapors rising from the inlet 42. Some solvent is also removed from the asphalt mix injected through the inlet 40. Therefore, the amount of solvent in the asphalt mix passing through the coker heater 28 can be adjusted by controlling the relative amounts of asphalt mix taken from line 26, from which no solvent has been removed, and asphalt mix taken from the fractionator 36, from which solvent has been removed. Thus, for example, where increased flow of solvent to the delayed coker heater 28 is desired in order to provide the proper residence time in the heater for the asphalt mix in order to avoid overcracking and to increase run lengths, that is, the time between delayed coking shutdowns for the purpose of cleaning the delayed coker heater, the flow in the line 26 to the delayed coker heater can be increased and the flow in the line 38 to the fractionator 36 can be decreased, as by the use of valves.

The solvent in the asphalt mix is vaporized in the delayed coker heater 28, and thereby helps provide adequate fluid velocities to the asphalt mix through the tubes of the delayed coker heater to provide the proper residence time, that is, a time long enough so that the temperature of the asphalt mix is raised to a level sufficient for coke to form in the coke drums 30 and 32 and short enough so that deposits do not form in the conduits of the delayed coker heater. In a conventional delayed coker process, the ordinary feed of the heavy bottoms of petroleum is absent a constituent which, upon vaporization, can provide such flow velocities. As a result, the injection of an additional fluid, such as steam or condensate, is required to assist the flow of the feed through the delayed coker heater. Such an injected external fluid is normally recovered as sour water in drum 46 and is contaminated by its contact with the sour coker products of the heavy bottoms in the delayed coker section. Although some injection of steam or condensate may be necessary in addition to the vaporization of the solvent in the feed of asphalt mixture, the amount is reduced and with it the pollution problems presented by the external fluid injection. As options, the asphalt mix can be diluted by the injection to the asphalt mix of light coker gas oil from the fractionator 36, which contains constituents which will vaporize in the delayed coker heater 28 and additional heat can be added to the asphalt mix by a delayed coker feed preheater 86.

In addition to separating solvent from the deasphalted oil mix and feeding it to the extractor 12, the solvent recovery system 84 feeds the deasphalted oil through the line 22 to the stripper 24 connected to the fractionator 36 in the delayed coking section. The stripper 24 can also receive feeds of light coker gas oil and heavy coker gas oil via lines 88 and 90, respectively, from the fractionator 36 and employs a fluid such as steam to strip light hydrocarbons and $H_2S$ from a mixture of the three oils. This mixture is produced at a relatively high temperature and constant flow, thereby providing the opportunity of using the three oil mixture to provide heat for various portions of the apparatus, such as in the delayed coker vapor recovery section. As an alternative, it may be desirable to strip the deasphalted oil independently or with only one other fluid, such as heavy coker gas oil.

The solvent vaporized in the delayed coker heater 28 condenses in the overhead drum 46 connected to the fractionator overhead, from which it can be used as lean oil for high recovery of $C_3/C_4$ hydrocarbons in the absorber stripper 58. Makeup solvent to the solvent deasphalting section is heated in a heat exchanger 92 in the delayed coker fractionator overhead, thereby further reducing the need for external energy sources to provide required heat for the combined process of solvent deasphalting and delayed coking. An alternate source of solvent makeup is light naphtha which can be recovered as a sidestream from the stabilizer 68, as through a separate naphtha splitter 93 and a line 94. This will provide an internal recycle of solvent to a solvent makeup line 96 to reduce the need for solvent makeup.

It is understood the pumps, valves and other devices are employed to move fluids and to control their flow through the apparatus for the process according to the present invention, and that additional heaters and coolers not specifically described herein are also used. It is further understood that heat may be added at other points in the process and apparatus according to the present invention, that some features of the invention can be employed without a use of other features, and that other additions and modifications may be made without departing from the spirit and scope of the present invention.

We claim:

1. A process for treating a heavy hydrocarbon fluid containing asphaltenes comprising:

contacting said heavy hydrocarbon fluid with a solvent, wherein the solvent is light naphtha, $C_4$ hydrocarbons, $C_5$ hydrocarbons, $C_6$ hydrocarbons, or a mixture of any of light naphtha and $C_4$, $C_5$ and $C_6$ hydrocarbons, to obtain an asphalt mix, containing asphalt and said solvent, and deasphalted oil mix, containing deasphalted oil and said solvent;

feeding said asphalt mix to a delayed coking process to form coke, wherein said asphalt mix is heated by passing said asphalt mix through conduit means in a heater in the delayed coking process, the flow of said asphalt mix through said conduit means being assisted by vaporization in said heater of the solvent in said asphalt mix, and said asphalt mix includes sufficient solvent to provide a residence time of said asphalt mix in said heater adequate for heating said asphalt mix for coking while reducing the formation of coke in said heater;

separating the solvent in the deasphalted oil mix from the deasphalted oil mix to yield deasphalted oil; and recovering said deasphalted oil, bypassing said delayed coking process.

2. The process according to claim 1, wherein said delayed coking process forms at least one fluid having a temperature higher than the temperature of the deasphalted oil mix, and the process further comprises using said higher temperature fluid to heat said deasphalted oil mix.

3. The process according to claim 2, wherein said higher temperature fluid is heavy coker gas oil.

4. The process according to claim 1, wherein the solvent is separated from the deasphalted oil mix in a solvent recovery system, and the process further comprises adding makeup solvent to the solvent recovery system and using heat from the overhead of a fractionator in the delayed coking process to heat the makeup solvent.

5. The process according to claim 4, wherein vapors including the solvent are recovered from the delayed coking process, and the solvent is taken off and added to said makeup solvent.

6. The process according to claim 3, wherein said heavy coker gas oil is directed to a stripper, and said deasphalted oil is stripped with said heavy coker gas oil in said stripper.

7. The process according to claim 1, wherein said delayed coking process forms light coker gas oil, said light coker gas oil is directed to a stripper, and said deasphalted oil is stripped with said light coker gas oil in said stripper.

8. The process according to claim 6, wherein said delayed coking process also forms light coker gas oil, said light coker gas oil is directed to said stripper, and said deasphalted oil is stripped with said heavy coker gas oil and said light coker gas oil in said stripper.

9. The process according to claim 1, wherein a first portion of said asphalt mix is fed directly to a delayed coker heater and a second portion of said asphalt mix is fed to said delayed coker heater through a delayed coker fractionator, some of said solvent being removed from said second portion in said delayed coker fractionator, and the process further comprises adjusting the amount of solvent fed to said delayed coker heater by adjusting the relative amounts of said first and second portions fed to said delayed coker heater.

10. The process according to claim 1, wherein the solvent is light naphtha.

11. The process according to claim 1, wherein the delayed coking process yields light coker gas oil, and the light coker gas oil is fed into the asphalt mix upstream of the delayed coking process in order to provide additional constituents which assist the flow of the asphalt mix through the conduit means in the heater.

12. The process according to claim 1, wherein the delayed coking process produces in a fractionator overhead vapors from which lean oil is condensed.

* * * * *